US006937252B1

(12) United States Patent
Ogawa

(10) Patent No.: US 6,937,252 B1
(45) Date of Patent: Aug. 30, 2005

(54) IMAGE DISPLAY METHOD AND IMAGE DISPLAY UNIT

(75) Inventor: Eiji Ogawa, Kaisei-machi (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 297 days.

(21) Appl. No.: 09/640,684

(22) Filed: Aug. 18, 2000

(30) Foreign Application Priority Data

Aug. 19, 1999 (JP) ..... 11/232576

(51) Int. Cl.[7] ..... G09G 5/10
(52) U.S. Cl. ..... 345/589; 345/690
(58) Field of Search ..... 345/112, 77, 61, 345/56, 63, 89, 581, 589, 690, 691, 722, 345/12; 348/674, 625, 131, 353, 380, 238, 348/396.1

(56) References Cited

U.S. PATENT DOCUMENTS 5,305,204 A * 4/1994 Ohhashi ..... 382/131
5,526,058 A * 6/1996 Sano et al. ..... 382/131
5,550,888 A * 8/1996 Neitzel et al. ..... 378/98.7
6,480,300 B1 * 11/2002 Aoyama ..... 358/1.9
6,603,450 B1 * 8/2003 Yamazaki et al. ..... 345/75.2

OTHER PUBLICATIONS

L.A. Geddes and L.E. Baker, "principles of applied biomedical instrumentation", 1989, Wiley Interscience, third edition, pp. 453-536.*

* cited by examiner

*Primary Examiner*—Jeffery Brier
*Assistant Examiner*—Javid Amini
(74) *Attorney, Agent, or Firm*—Sughrue Mion, PLLC

(57) ABSTRACT

Disclosed herein is an image display unit comprising a brightness circuit which has an output brightness characteristic in which the logarithmic value of the output density of an input image signal becomes smaller as the value of the image signal becomes larger. The output brightness characteristic is set so that a rate of change, which represents a change in the logarithmic value of the output brightness with respect to a change in the signal value, in the low signal value region of the image signal becomes smaller than that in the intermediate and high signal value region of the image signal.

28 Claims, 4 Drawing Sheets

IMAGE DISPLAY METHOD AND IMAGE DISPLAY UNIT

BACKGROUND OF THE INVENTION

1. Field of the Invention

The present invention relates in general to an image display method and an image display unit, and in particular to an improvement in the output brightness characteristic between an input signal and its output brightness.

2. Description of the Related Art

In the medical field, a human body is irradiated with radiation, the radiation-transmitted image is recorded on X-ray film, and while the X-ray film recorded with radiation-transmitted image is being held to a light source or schaukasten (which is a box for observing X-ray film), the transmitted light image is observed and analyzed.

On the other hand, because of the recent development of digital technology it is becoming standard to digitize and process the aforementioned radiation-transmitted image by computers. It has also become possible to observe and analyze the aforementioned radiation-transmitted image stored as a digital image on a server, etc., by displaying it immediately on an image display unit, such as a cathode-ray tube (CRT) display unit, connected to a network, without outputting it to X-ray film for every display.

If an image as viewed with the X-ray film held to the schaukasten is compared with an image as viewed with it displayed on a CRT display unit, etc., incidentally, there is a difference in how the two images look.

The image display unit, such as a CRT display unit, etc., is generally grouped into two types. One type has an output brightness characteristic in which an input image signal S and its output brightness L are in a linear relationship (FIG. 3A). Another type has an output brightness characteristic in which an input image signal S and a logarithmic value Y ($=\log_{10}(L)$) of its output brightness L are in a linear relationship (FIG. 3B). The display unit having the output brightness characteristic shown in FIG. 3B is most suitable to make the human eyes feel contrast (hereinafter referred to as visual effect).

On the other hand, the X-ray film, as shown in FIG. 4A, exhibits an output brightness characteristic in which an input image signal S and its output density D are approximately linear, but the sensitivity of the output density D with respect to the input image signal S is reduced at the low signal value region. Also, when viewing an image recorded on X-ray film of such an output brightness characteristic, with the film held to the schaukasten, an image portion of high density is recognized as an image portion of low brightness and an image portion of low density is recognized as an image portion of high density, as shown in FIG. 4B. Therefore, for the image viewed with the X-ray film held to the schaukasten, the sensitivity of the output brightness (logarithmic value) to the value of an input signal becomes lower in the low signal value region corresponding to the image portion of low density than in other intermediate and high signal value regions.

Thus, between an image as viewed with X-ray film held to the schaukasten and an image as viewed with it displayed on an image display unit such as a CRT display unit, etc., there is a difference in the sensitivity of the output brightness in the low signal value region. Because of this, there are cases where doctors, etc., who are used to the analysis of an image output to X-ray film which is the traditional method of analyzing an image, will feel a sense of incompatibility with respect to an image displayed on an image display unit. There is also a possibility that a sense of incompatibility such as this will inhibit disturb accurate analysis.

SUMMARY OF THE INVENTION

The present invention has been made in view of the drawbacks found in the prior art. Accordingly, it is the primary object of the present invention to provide an image display method and an image display unit which are capable of displaying an image that has the same visual effect as an image output to X-ray film (hereinafter referred to as feeling of contrast).

In the image display method and image display unit of the present invention, a rate of change, which is a change in the output brightness of an input image signal with respect to a change in the value of the image signal, in the low signal value region of the image signal is made smaller than a rate of change in the intermediate and high signal value region of the image signal, so that the same visual effect is obtained as for the case in which an image represented by the image signal is output and viewed as a gray image to X-ray film.

In accordance with present invention, there is provided an image display method, which has an output brightness characteristic in which a logarithmic value of an output brightness becomes smaller as a value of an input image signal becomes greater, for displaying a visible image that the image signal represents according to the output brightness characteristic, the image display method comprising the step of:

setting the output brightness characteristic so that a rate of change, which represents a change in the logarithmic value of the output brightness with respect to a change in the signal value, in a low signal value region of the image signal becomes smaller than that in an intermediate and high signal value region of the image signal.

Thus, by making the change rate of the logarithmic value of the output brightness in the low signal value region of the input image signal (gradient of the logarithm of the output brightness with respect to the input image signal) smaller than the change rate in the intermediate and high signal value region of the image signal, and by then displaying the image on a CRT display unit, etc., the image can be observed as an image having the same visual effect as the case in which the image is output to X-ray film having a density characteristic in which the change rate of the density in the low signal value region is smaller than that in the intermediate and high signal value region. The transmitted light image is then viewed with this film (hard copy) held to a light source or schaukasten. Note that a small change rate means the absolute value of the change rate is small. Likewise, a large change rate means that the absolute value of the change rate is large.

It is preferable that the output brightness characteristic be approximately linear over approximately the entire intermediate and high signal value region, because an image more similar in visual effect to the image in the case of outputting it to the aforementioned film can be displayed.

Preferably, a boundary value $S_a$ between the low signal value region and the intermediate and high signal value region is a value in the range of the following Eq. 1 by test and experience. It is also preferable to set the aforementioned output brightness characteristic so that a logarithmic value $Y(S_a)$ of the output brightness at the boundary value $S_a$ is a value in the range of the following Eq. 2.

$$0.05\times S_{max} \leqq S_a \leqq 0.30\times S_{max} \quad (1)$$

$$Y_{max}-0.25 \leqq Y(S_a) \leqq Y_{max}-0.05 \quad (2)$$

where $S_{max}$ represents the maximum value of the image signal in the aforementioned output brightness characteristic and $Y_{max}$ represents the maximum value of the logarithmic value of the brightness in the aforementioned output brightness characteristic. Note that an optimum value $S_a$ as the boundary value is a value in the range of the following Eq. 1'. It is optimum to set the logarithmic value $Y(S_a)$ of the output brightness at this time to $(Y_{max}-0.15)$.

$$0.16\times S_{max} \leqq S_a \leqq 0.20\times S_{max} \quad (1)$$

In addition, it is desirable that the change rate G in the aforementioned intermediate and high signal value region be a value within the range represented by the following Eq. 3. Optimally the change rate G is $-(2.88/S_{max})$.

$$-(3.0/S_{max}) \leqq G \leqq -(2.5/S_{max}) \quad (3)$$

In the aforementioned image display method of the present invention, the intermediate and high signal value region is further divided into an intermediate signal value region and a high signal value region. It is also preferred to make a change rate in the high signal value region greater than that in the intermediate signal value region (i.e., to make the gradient of the logarithm of the output brightness with respect to an input image signal sharper).

The reason for this is that in the high signal value region, i.e., the low brightness region, a feeling of contrast of a displayed visible image tends to be reduced because of ambient light, so if the change rate in the high signal value region is made greater than that in the intermediate signal value region, a reduction in the feeling of contrast, due to ambient light, can be suppressed.

Preferably, the output brightness characteristic is approximately linear over approximately the entire intermediate signal value region, and the aforementioned change rate in the high signal value region is made greater. Furthermore, it is preferable that the output brightness characteristic be approximately linear over approximately the entire high signal value region. In this way, an image more similar in visual effect to the image in the case of outputting it to the aforementioned film can be displayed, even if there is an influence of ambient light.

Preferably, a boundary value $S_b$ between the aforementioned low signal value region and the aforementioned intermediate and high signal value region is a value in the range of the following Eq. 4 by test and experience. It is also preferred to set the aforementioned output brightness characteristic so that a logarithmic value $Y(S_b)(=\log_{10}(L(S_b))$ of the output brightness $L(S_b)$ at the boundary value $S_b$ is a value in the range of the following Eq. 5.

$$0.70\times S_{max} \leqq S_b \leqq 1.00\times S_{max} \quad (4)$$

$$Y_{max}-2.15 \leqq Y(S_a) \leqq Y_{max}-1.95 \quad (5)$$

Note that an optimum value $S_b$ as the boundary value is a value within the range of the following Eq. 4'. It is optimum to set the logarithmic value $Y(S_b)$ of the output brightness at this time to $(Y_{max}-2.03)$.

$$0.80\times S_{max} \leqq S_b \leqq 0.90\times S_{max} \quad (4')$$

In addition, it is desirable that the change rate G in the aforementioned intermediate signal value region be a value within the range represented by the following Eq. 3.

In accordance with the present invention, there is provided an image display unit, which comprises a brightness circuit having an output brightness characteristic in which a logarithmic value of an output brightness becomes smaller as a value of an input image signal becomes greater, for displaying a visible image that the image signal represents according to the output brightness characteristic. In image display unit, the output brightness characteristic in the brightness circuit is set so that a rate of change, which represents a change in the logarithmic value of the output brightness with respect to a change in the signal value, in a low signal value region of the image signal becomes smaller than that in an intermediate and high signal value region of the image signal.

It is preferable that the aforementioned output brightness characteristic of the brightness circuit be approximately linear over approximately the entire intermediate and high signal value region.

Preferably, a boundary value $S_a$ between the low signal value region and the intermediate and high signal value region is a value represented by the aforementioned Eq. 1. It is also preferable to set a logarithmic value $Y(S_a)$ of the output brightness at the boundary value $S_a$ to a value in the range of the aforementioned Eq. 2. An optimum value $S_a$, as the boundary value is a value in the range of the aforementioned Eq. 1'. It is optimum to set the logarithmic value $Y(S_a)$ of the output brightness at this time to $(Y_{max}-0.15)$.

Furthermore, it is desirable that the change rate G in the intermediate and high signal value region be a value within a range represented by the aforementioned Eq. 3. Optimally the change rate G is $-(2.88/S_{max})$.

In the aforementioned image display unit of the present invention, the intermediate and high signal value region is similarly divided into an intermediate signal value region and a high signal value region. It is also preferred to make a change rate in the high signal value region greater than that in the intermediate signal value region. In this way, a reduction in a feeling of contrast of a displayed visible image, which is caused by the influence of ambient light, can be suppressed.

Preferably, the output brightness characteristic is approximately linear over approximately the entire intermediate signal value region, and the aforementioned change rate in the high signal value region is made greater. Furthermore, it is preferable that the output brightness characteristic be approximately linear over approximately the entire high signal value region. In this way, an image more similar in visual effect to the image in the case of outputting it to the aforementioned film can be displayed, even if there is an influence of ambient light.

Preferably, a boundary value $S_b$ between the aforementioned low signal value region and the aforementioned intermediate and high signal value region is a value in the range of the aforementioned Eq. 4 by test and experience. It is also preferred to set the aforementioned output brightness characteristic so that a logarithmic value $Y(S_b)(=\log_{10}(L(S_b))$ of the output brightness $L(S_b)$ at the boundary value $S_b$ is a value in the range of the aforementioned Eq. 5.

Note that an optimum value $S_b$ as the boundary value is a value within the range of the aforementioned Eq. 4'. It is optimum to set the logarithmic value $Y(S_b)$ of the output brightness at this time to $(Y_{max}-2.03)$.

In addition, it is desirable that the change rate G in the aforementioned intermediate signal value region be a value within the range represented by the aforementioned Eq. 3.

The aforementioned image display method and image display unit of the present invention are more effective in the case where a medical image, particularly an image signal representing a radiation image, is employed as an input image signal.

According to the image display method and image display unit of the present invention, a rate of change in the logarithmic value of the output brightness in the low signal value region of an input image signal is made smaller than that in the intermediate and high signal value region of the image signal, and the image signal is displayed on a CRT display unit. etc. Therefore, the displayed image can be viewed as an image having the same visual effect as the case in which the image is output to X-ray film having a density characteristic in which a change rate of the density in the low signal value region is smaller than that of the density in the intermediate and high speed value region, and the transmitted light image is viewed with this X-ray film held to a light source or schaukasten.

Therefore, particularly in the medical field, doctors, etc., who are accustomed to the analysis of an image output to X-ray film, can analyze an image displayed on a CRT display unit, etc., without a sense of incompatibility, and perform accurate analysis, based on the image displayed on the CRT display unit, etc., without outputting it to X-ray film.

BRIEF DESCRIPTION OF THE DRAWINGS

The above and other objects and advantages will become apparent from the following detailed description when read in conjunction with the accompanying drawings wherein.

DESCRIPTION OF THE PREFERRED EMBODIMENT

Figure 1:
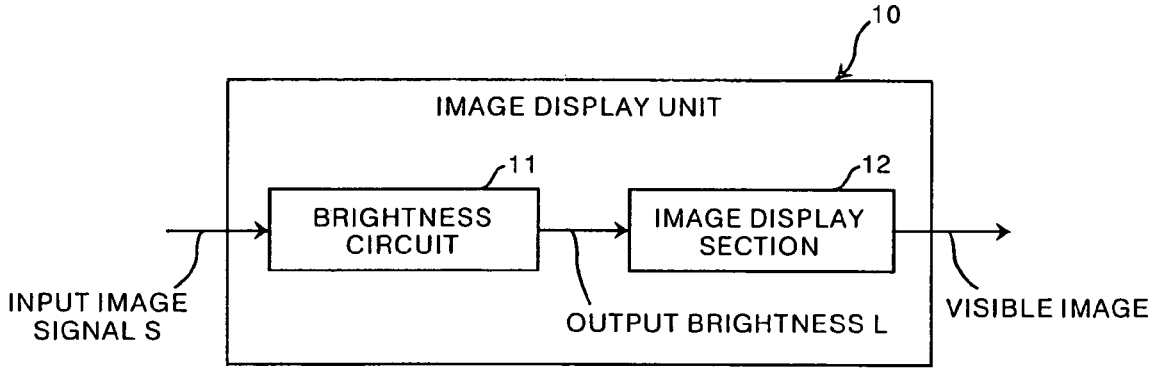
FIG. 1 is a block diagram showing an embodiment of an image display unit of the present invention.

Referring to FIG. 1, there is shown an image display unit in accordance with a preferred embodiment of the present invention. The image display unit 10 is constructed of a brightness circuit 11 and an image display section 12. The brightness circuit 11 has an output brightness characteristic in which an input image signal S and its output brightness L are in a predetermined relationship. The image display section 12 visually displays an image that the input image signal represents in the brightness L output from the brightness circuit 11.

Figure 2A:
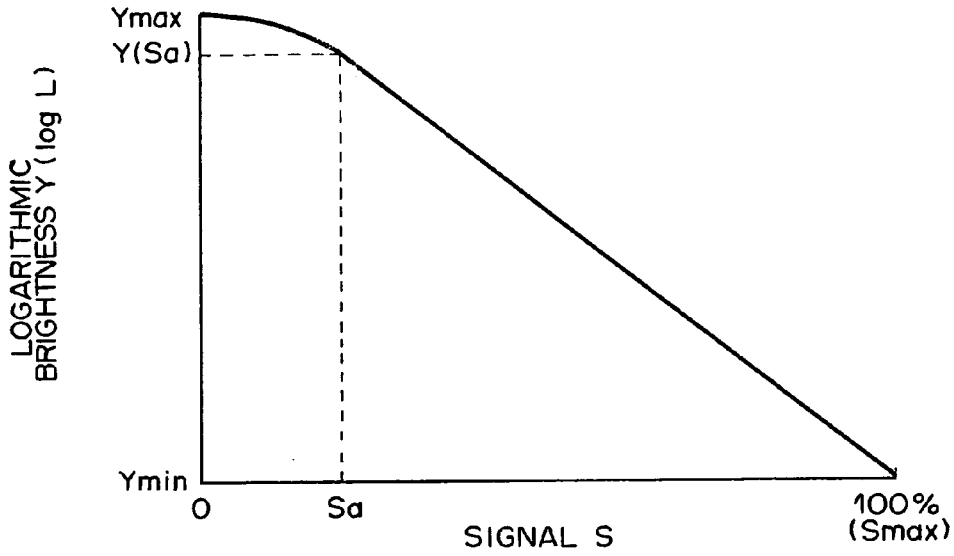
FIG. 2A is a graph showing an output brightness characteristic which represents the relationship between an input image signal and a logarithmic value of its output brightness.
Figure 2B:
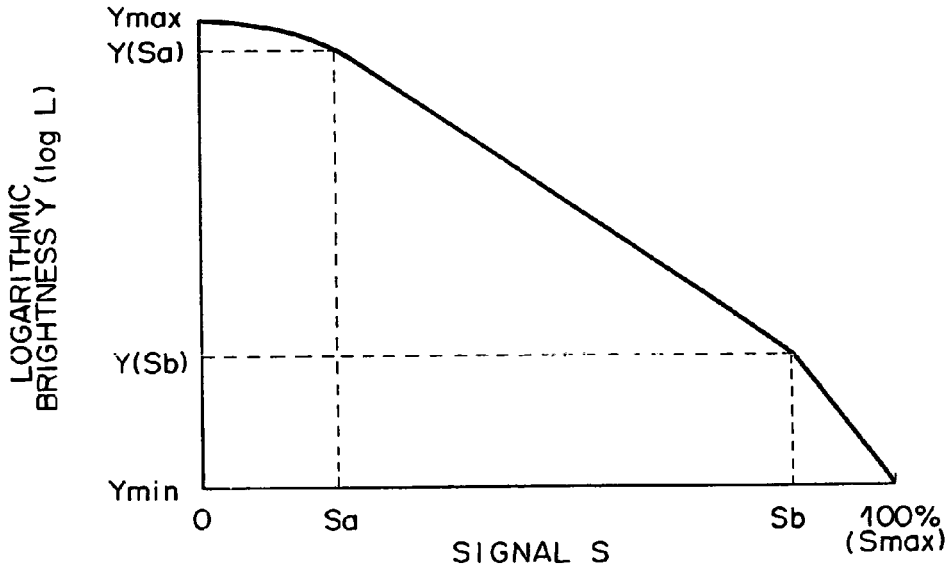
FIG. 2B is a graph showing another output brightness characteristic which represents the relationship between an input image signal and a logarithmic value of its output brightness.
Figure 3A:
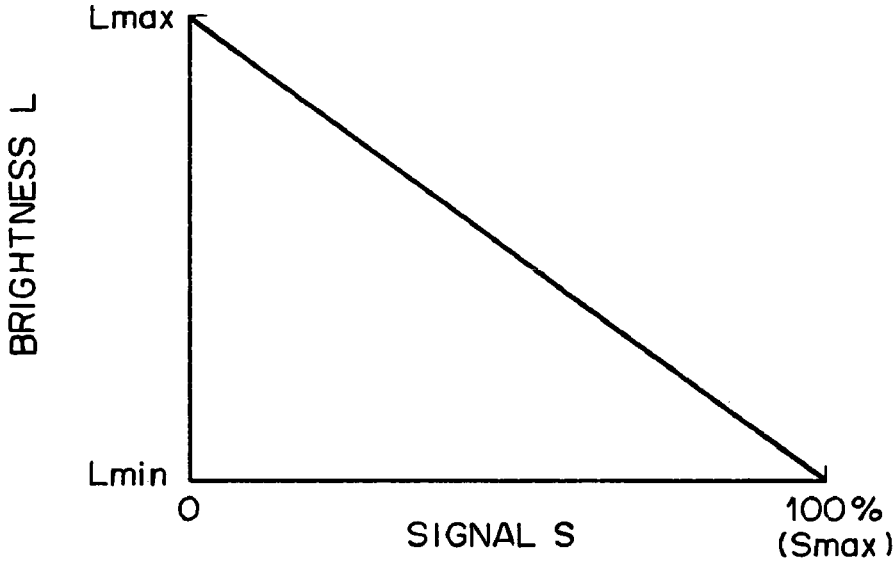
FIG. 3A is a graph showing the output brightness characteristic of a conventional image display unit in which an input image signal and its output brightness are in a linear relationship.
Figure 3B:
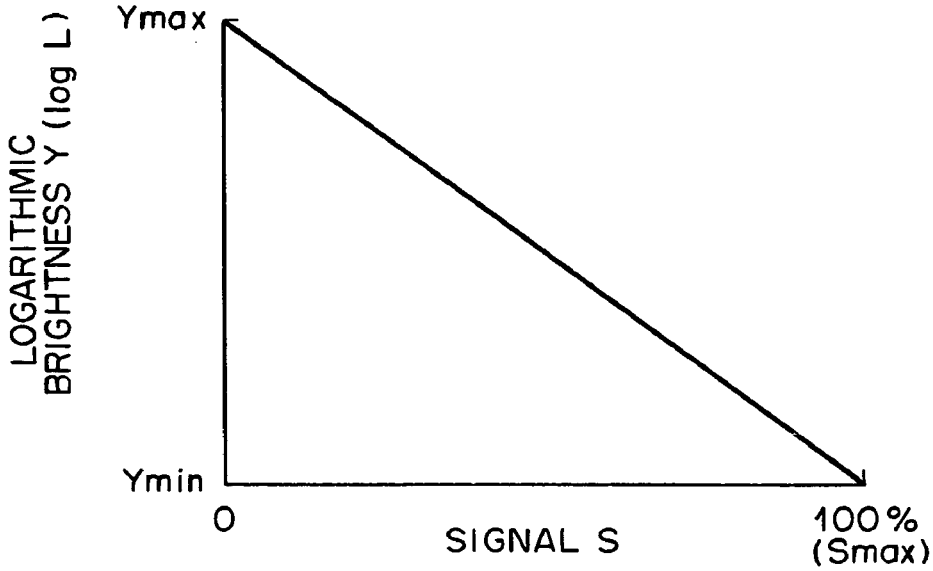
FIG. 3B is a graph showing the output brightness characteristic of another conventional image display unit in which an input image signal and a logarithmic value of its output brightness are in a linear relationship.

The output brightness characteristic of the brightness circuit 11 is a characteristic in which the logarithmic value Y (=log(L)) of the output brightness L becomes smaller as the value of the input image signal S becomes larger, as shown FIG. 2A. A rate of change $|G_{0-a}|$(=$|\Delta Y/\Delta S|$: absolute value of the differentiated value of Y with respect to the differentiated value of S), which represents a change in the logarithmic value Y of the output brightness L with respect to a change in the image signal S, in the low signal value region of the image signal S ($0 \leqq S \leqq S_a$) is set smaller than a rate of change $|G_{a-100}|$ in the intermediate and high signal value region of the image signal ($S_a$<S)($|G_{0-a}|<|G_{a-100}|$). Note that the boundary value $S_a$ between the low signal value region and the intermediate and high signal value region is set to a value in the range of the following Eq. 1'. For instance, it is set to $S_a=0.18\times S_{max}$ where $S_{max}$ represents the maximum value of the image signal in the output brightness characteristic.

$$0.16\times S_{max} \leqq S_a \leqq 0.20\times S_{max} \quad (1)$$

On the other hand, the logarithmic value Y ($S_a$) of the output brightness L ($S_a$) at the boundary value $S_a$ is set to a value in the range of the following Eq. 2. For example, it is set to $Y(S_a)=Y_{max}-0.15$ where $Y_{max}$ represents the maximum value of the logarithmic value of the brightness in the output brightness characteristic.

$$Y_{max}-0.25 \leqq Y(S_a) \leqq Y_{max}-0.05 \quad (2)$$

In addition, the rate of change $G_{a-100}$ in the intermediate and high signal value region ($S_a$<S) of the image signal S is set to a value in the range of the following Eq. 3, for example, $G_{a-100}=-2.88/S_{max}$.

$$-(3.0/S_{max}) \leqq G_{a-100} \leqq -(2.5/S_{max}) \quad (3)$$

Figure 4A:
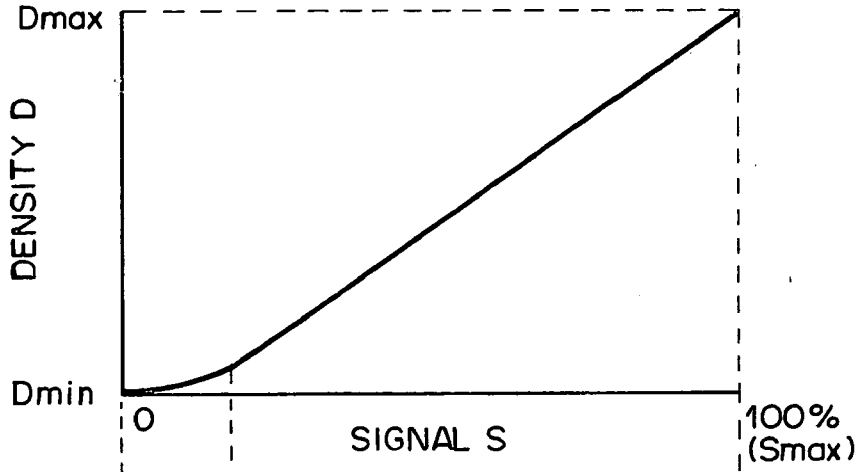
FIG. 4A is a graph showing the output density characteristic of X-ray film which represents the relationship between an input image signal and its output density.
Figure 4B:
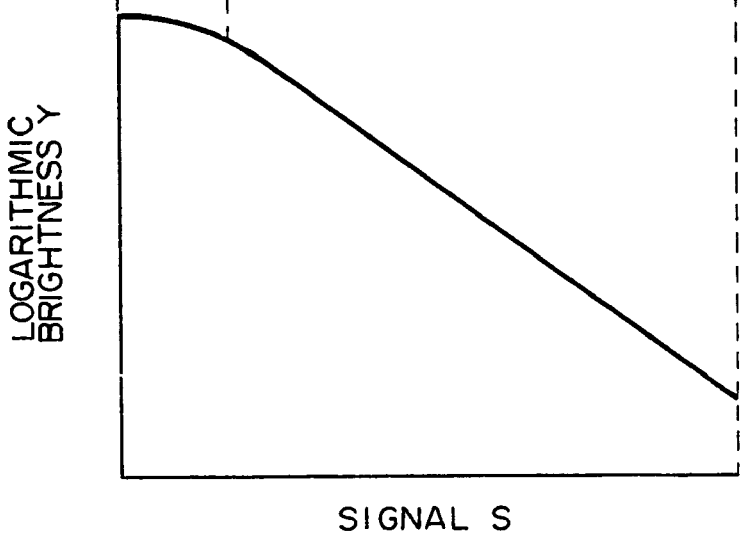
FIG. 4B is a graph showing the brightness characteristic when the X-ray film of FIG. 4A is held to the schaukasten.

The visible image, displayed on the image display section 12 in the brightness L output from the brightness circuit 11 having the output brightness characteristic thus set, can be observed as an image having the same visual effect (see FIG. 2A) as the case in which the image is output to X-ray film having a density characteristic (see FIG. 4) in which a change rate of the density in the low signal value region is smaller than that of the density in the intermediate and high speed value region, and the transmitted light image is viewed with this X-ray film held to a light source or schaukasten.

Therefore, doctors, etc., who are familiar with the analysis of an image output to X-ray film, can analyze an image displayed on the display section 12 without a sense of incompatibility, and perform accurate analysis, based on the image displayed on the display section 12, without outputting it to the X-ray film.

Note that in the output brightness characteristic of the brightness circuit 11, it is more desirable to set a rate of change $|G_{b-100}|$ in the high signal value region ($S_b \leqq S \leqq S_{max}$) greater than a rate of change $|G_{a-b}|$ in the intermediate signal value region ($S_a \leqq S \leqq S_b$) ($|G_{a-b}|<|G_{b-100}|$). The boundary value $S_b$ between the intermediate signal value region and the high signal value region is set to a value in the range of the following Eq. 4'. For instance, it is set to $S_b=0.83\times S_{max}$.

$$0.80\times S_{max} \leqq S_b \leqq 0.90\times S_{max} \quad (4')$$

On the other hand, the logarithmic value Y ($S_b$) of the output brightness L ($S_b$) at the boundary value $S_b$ is set to a value in the range of the following Eq. 5. For example, it is set to $Y(S_b)=Y_{max}-2.03$.

$$Y_{max}-2.15 \leqq Y(S_b) \leqq Y_{max}-1.95 \quad (5)$$

The visible image, displayed on the image display section 12 in the brightness L output from the brightness circuit 11 having the output brightness characteristic thus set, can be observed as an image having the same visual effect (contrast (see FIG. 2A)) as the case in which the image is output to X-ray film having a density characteristic (see FIG. 4) in which a change rate of the density in the low signal value region is smaller than that of the density in the intermediate and high speed value region, and the transmitted light image is viewed with this X-ray film held to a light source or schaukasten.

While a certain representative embodiment and details have been shown for the purpose of illustrating the present invention, it will be apparent to those skilled in this art that various changes and modifications may be made without departing from the scope of the invention hereinafter claimed.

In addition, all of the contents of Japanese Patent Application No. 11(1999)-232576 are incorporated into this specification by reference.

What is claimed is:

1. An image display method, which has an output brightness characteristic in which a logarithmic value of an output brightness becomes smaller as a value of an input image signal becomes larger, for displaying a visible image that said input image signal represents according to said output brightness characteristic, the image display method comprising the step of:

setting said output brightness characteristic so that a rate of change, which represents a change in a logarithmic value of said output brightness with respect to a change in the value of said input image signal, in a first region of said image signal which is below a boundary value $S_a$ becomes smaller than that in a second region of said input image signal which is above a boundary value $S_a$;

wherein the boundary value $S_a$ between the first region and the second region is represented by the following equation:

$$0.05\times S_{max}\leqq S_a\leqq 0.30\times S_{max}$$

where $S_{max}$ is the maximum value of the image signal in the output brightness characteristic.

2. The image display method as set forth in claim 1, wherein said output brightness characteristic is approximately linear over approximately the entire second region.

3. The image display method as set forth in claim 1, wherein a logarithmic value $Y(S_a)$ of said output brightness at said boundary value $S_a$ is represented by the following equation:

$$Y_{max}-0.25\leqq Y(S_a)\leqq Y_{max}-0.05$$

where $Y_{max}$ is the maximum value of the logarithmic value of the brightness in said output brightness characteristic.

4. The image display method as set forth in claim 2, wherein a logarithmic value $Y(S_a)$ of said output brightness at said boundary value $S_a$ is represented by the following equation:

$$Y_{max}-0.25\leqq Y(S_a)\leqq Y_{max}-0.05$$

where $Y_{max}$ is the maximum value of the logarithmic value of the brightness in said output brightness characteristic.

5. The image display method as set forth in claim 1, wherein said change rate in said second region is represented by the following equation:

$$-(3.0/S_{max})\leqq G\leqq -(2.5/S_{max})$$

where G is said change rate.

6. The image display method as set forth in claim 2, wherein said change rate in said second region is represented by the following equation:

$$-(3.0/S_{max})\leqq G\leqq -(2.5/S_{max})$$

where G is said change rate.

7. The image display method as set forth in claim 3, wherein said change rate in said second region is represented by the following equation:

$$-(3.0/S_{max})\leqq G\leqq -(2.5/S_{max})$$

where G is said change rate.

8. The image display method as set forth in claim 1, wherein said output brightness characteristic is set so that said change rate in a first portion of the second region of said image signal becomes greater than that in a second portion of the second region of said image signal.

9. The image display method as set forth in claim 8, wherein said output brightness characteristic is approximately linear over approximately the entire second portion of the second region and over approximately the entire first portion of the second region.

10. The image display method as set forth in claim 8, wherein a logarithmic value $Y(S_a)$ of said output brightness at said boundary value $S_a$, a boundary value $S_b$ between said second portion of the second region and said first portion of the second region, and a logarithmic value $Y(S_b)$ of said output brightness at said boundary value $S_b$ are represented by the following equations:

$$0.70\times S_{max}\leqq S_b\leqq 1.00\times S_{max}$$

$$Y_{max}-0.25\leqq Y(S_a)\leqq Y_{max}-0.05$$

$$Y_{max}-2.15\leqq Y(S_b)\leqq Y_{max}-1.95$$

where $Y_{max}$ is the maximum value of the logarithmic value of the brightness in said output brightness characteristic.

11. The image display method as set forth in claim 9, wherein a logarithmic value $Y(S_a)$ of said output brightness at said boundary value $S_a$, a boundary value $S_b$ between said second portion of the second region and said first portion of the second region, and a logarithmic value $Y(S_b)$ of said output brightness at said boundary value $S_b$ are represented by the following equations:

$$0.05\times S_{max}\leqq S_a\leqq 0.30\times S_{max}$$

$$0.70\times S_{max}\leqq S_b 1.00\times S_{max}$$

$$Y_{max}-0.25\leqq Y(S_a)\leqq Y_{max}-0.05$$

$$Y_{max}-2.15\leqq Y(S_b)\leqq Y_{max}-1.95$$

where $Y_{max}$ is the maximum value of the logarithmic value of the brightness in said output brightness characteristic.

12. The image display method as set forth in claim 8, wherein said change rate in said second portion of the second region is represented by the following equation:

$$-(3.0/S_{max})\leqq G\leqq -(2.5/S_{max})$$

where G is said change rate.

13. The image display method as set forth in claim 9, wherein said change rate in said second portion of the second region is represented by the following equation:

$$-(3.0/S_{max}) \leqq G \leqq -(2.5/S_{max})$$

where G is said change rate.

14. The image display method as set forth in claim 10, wherein said change rate in said second portion of the second region is represented by the following equation:

$$-(3.0/S_{max}) \leqq G \leqq -(2.5/S_{max})$$

where G is said change rate.

15. In an image display unit, which comprises a brightness circuit having an output brightness characteristic in which a logarithmic value of an output brightness becomes smaller as a value of an input image signal becomes larger, for displaying a visible image that said input image signal represents according to said output brightness characteristic, the improvement wherein said output brightness characteristic in said brightness circuit is set so that a rate of change, which represents a change in the logarithmic value of said output brightness with respect to a change in said input image signal value, in a first region of said image signal which is below a boundary value $S_a$ becomes smaller than that in second region of said input image signal which is above a boundary value $S_a$;

wherein the boundary value $S_a$ between the first region and the second region is represented by the following equation:

$$0.05 \times S_{max} \leqq S_a \leqq 0.30 \times S_{max}$$

where $S_{max}$ is the maximum value of the image signal in the output brightness characteristic.

16. The image display unit as set forth in claim 15, wherein said output brightness characteristic in said brightness circuit is approximately linear over approximately the entire second region.

17. The image display unit as set forth in claim 15, wherein a logarithmic value $Y(S_a)$ of said output brightness at said boundary value $S_a$ is represented by the following equation:

$$Y_{max} - 0.25 \leqq Y(S_a) \leqq Y_{max} - 0.05$$

in which $Y_{max}$ is the maximum value of the logarithmic value of the brightness in said output brightness characteristic.

18. The image display unit as set forth in claim 16, wherein a logarithmic value $Y(S_a)$ of said output brightness at said boundary value $S_a$ is represented by the following equations:

$$Y_{max} - 0.25 \leqq Y(S_a) \leqq Y_{max} - 0.05$$

in which $Y_{max}$ is the maximum value of the logarithmic value of the brightness in said output brightness characteristic.

19. The image display unit as set forth in claim 15, wherein said change rate in said second region is represented by the following equation:

$$-(3.0/S_{max}) \leqq G \leqq -(2.5/S_{max})$$

in which G is said change rate.

20. The image display unit as set forth in claim 16, wherein said change rate in said second region is represented by the following equation:

$$-(3.0/S_{max}) \leqq G \leqq -(2.5/S_{max})$$

in which G is said change rate.

21. The image display unit as set forth in claim 17, wherein said change rate in second region is represented by the following equation:

$$-(3.0/S_{max}) \leqq G \leqq -(2.5/S_{max})$$

in which G is said change rate.

22. The image display unit as set forth in claim 15, wherein said output brightness characteristic in said brightness circuit is set so that said change rate in the first portion of the second region of said image signal becomes larger than that in the second portion of the second region of said image signal.

23. The image display unit as set forth in claim 22, wherein said output brightness characteristic in said brightness circuit is approximately linear over approximately the entire second portion of the second region and over approximately the entire first portion of the second region.

24. The image display unit as set forth in claim 22, wherein a logarithmic value $Y(S_a)$ of said output brightness at said boundary value $S_a$, a boundary value $S_b$ between said second portion of the second region and said first portion of the second region, and a logarithmic value $Y(S_b)$ of said output brightness at said boundary value $S_b$ are represented by the following equations:

$$0.70 \times S_{max} \leqq S_b \leqq 1.00 \times S_{max}$$

$$Y_{max} - 0.25 \leqq Y(S_a) \leqq Y_{max} - 0.05$$

$$Y_{max} - 2.15 \leqq Y(S_b) \leqq Y_{max} - 1.95$$

in which $Y_{max}$ is the maximum value of the logarithmic value of the brightness in said output brightness characteristic.

25. The image display unit as set forth in claim 23, wherein a logarithmic value $Y(S_a)$ of said output brightness at said boundary value $S_a$, a boundary value $S_b$ between said second portion of the second region and said first portion of the second region, and a logarithmic value $Y(S_b)$ of said output brightness at said boundary value $S_b$ are represented by the following equations:

$$0.70 \times S_{max} \leqq S_b \leqq 1.00 \times S_{max}$$

$$Y_{max} \leqq 0.25 \leqq Y(S_a) \leqq Y_{max} - 0.05$$

$$Y_{max} - 2.15 \leqq Y(S_b) \leqq Y_{max} - 1.95$$

in which $Y_{max}$ is the maximum value of the logarithmic value of the brightness in said output brightness characteristic.

26. The image display unit as set forth in claim 22, wherein said change rate in said second portion of the second region is represented by the following equation:

$$-(3.0/S_{max}) \leqq G \leqq -(2.5/S_{max})$$

in which G is said change rate.

27. The image display unit as set forth in claim 23, wherein said change rate in said second portion of the second region is represented by the following equation:

$$-(3.0/S_{max}) \leqq G \leqq -(2.5/S_{max})$$

in which G is said change rate.

28. The image display unit as set forth in claim 24, wherein said change rate in said second portion of the second region is represented by the following equation:

$$(3.0/S_{max}) \leqq G \leqq -(2.5/S_{max})$$

in which G is said change rate.

* * * * *